US008696300B1

(12) United States Patent
Burke, Jr. et al.

(10) Patent No.: US 8,696,300 B1
(45) Date of Patent: Apr. 15, 2014

(54) BODY FAN DEVICE

(76) Inventors: Tony Burke, Jr., Philadelphia, PA (US); Tony Burke, Sr., Philadelphia, PA (US)

( * ) Notice: Subject to any disclaimer, the term of this patent is extended or adjusted under 35 U.S.C. 154(b) by 645 days.

(21) Appl. No.: 12/932,404

(22) Filed: Feb. 24, 2011

Related U.S. Application Data

(60) Provisional application No. 61/339,422, filed on Mar. 4, 2010.

(51) Int. Cl.

| | |
|---|---|
| ***F04D 29/52*** | (2006.01) |
| ***A41D 13/00*** | (2006.01) |
| ***F04D 19/00*** | (2006.01) |
| ***F04D 25/08*** | (2006.01) |
| ***F04D 29/40*** | (2006.01) |
| ***F04D 29/44*** | (2006.01) |
| ***F04D 29/64*** | (2006.01) |
| *A41D 13/002* | (2006.01) |
| *A41D 13/005* | (2006.01) |

(52) U.S. Cl.

CPC ..... *F04D 19/002* (2013.01); *F04D 25/08* (2013.01); *F04D 29/403* (2013.01); *F04D 29/441* (2013.01); *F04D 29/646* (2013.01); *A41D 13/0025* (2013.01); *A41D 13/0053* (2013.01)

USPC ..... 415/1; 415/211.2; 415/213.1; 415/214.1; 415/220

(58) Field of Classification Search

USPC ..... 415/1, 211.1, 213.1, 214.1, 220; 2/69, 2/81

See application file for complete search history.

(56) References Cited

U.S. PATENT DOCUMENTS

| | | | | |
|---|---|---|---|---|
| 2,826,758 | A * | 3/1958 | Kahn | 415/213.1 |
| 3,353,191 | A * | 11/1967 | Dahly | 416/146 R |
| 3,468,299 | A | 9/1969 | D'Amato et al. | |
| 5,564,124 | A | 10/1996 | Elsherif et al. | |
| D464,420 | S * | 10/2002 | Tolar | D23/382 |
| 7,143,451 | B2 * | 12/2006 | Lundgren | 2/171.3 |
| 7,272,946 | B2 | 9/2007 | Ichigaya | |
| 7,290,292 | B1 * | 11/2007 | Nellon | 2/171.3 |
| 2005/0278817 | A1 * | 12/2005 | Doheny | 2/69 |
| 2007/0281602 | A1 | 12/2007 | Barwick | |

* cited by examiner

*Primary Examiner* — Igor Kershteyn

(74) *Attorney, Agent, or Firm* — Emery L. Tracy; Ruth Eure

(57) ABSTRACT

A body fan device for keeping a user cool, dry, and comfortable when wearing a garment is provided. The body fan device comprises an outer casing having a front side and a rear side with the front side directed toward the user and the rear side directed toward the garment. A fan is mounted between the front side and the rear side. A power mechanism powers the fan. A securing mechanism secures the outer casing between the garment and the user. A front vented panel is mounted to the front side of the outer casing and a rear vented panel mounted to the rear side of the outer casing. Upon activation of the fan, air is drawing through the rear vented panel inward into the outer casing and out through the front vented panel and against the user.

20 Claims, 1 Drawing Sheet

BODY FAN DEVICE

The present application claims the benefit of priority of pending provisional patent application Ser. No. 61/339,422, filed on Mar. 4, 2010, entitled "Body Fans".

BACKGROUND OF THE INVENTION

1. Field of the Invention

This invention relates generally to body fan device and, more particularly, the invention relates to body fan device providing users a simple means of staying cool, dry, and comfortable when wearing business attire.

2. Description of the Prior Art

Perspiration is a fact of life. In simple terms, perspiration is the evaporation of sweat through thousands of glands located all over the body. Serving to control body temperature by cooling the skin, perspiration is a natural process, necessary in maintaining optimal health. Occurring during activity or even when the body is at rest, perspiration can also be triggered by nervousness, excitement, anxiety or fear. Whether running a marathon, suffering a "hot flash" due to menopause or simply sitting comfortably reading a book, excessive perspiration can leave a person feeling uncomfortable, wet and unclean. Further, sweat can emit an unpleasant odor and can soil garments with unsightly and hard to remove stains. While many experience excessive sweating beneath the underarms, perspiration can occur on virtually all areas of the body. For business professionals and those attending events where business attire is required, wearing a suit jacket can render one feeling restricted and hot, thus lead to perspiration. As can be imagined, taking a jacket off at an important business meeting only to realize that one's dress shirt is saturated in sweat can be a completely embarrassing situation. While wearing even a light sport coat while attending an afternoon wedding reception in the hot summer sun can leave one feeling sticky, irritable and wet.

SUMMARY

The present invention is a body fan device for keeping a user cool, dry, and comfortable when wearing a garment. The body fan device comprises an outer casing having a front side and a rear side with the front side directed toward the user and the rear side directed toward the garment. A fan is mounted between the front side and the rear side. A power mechanism powers the fan. A securing mechanism secures the outer casing between the garment and the user. A front vented panel is mounted to the front side of the outer casing and a rear vented panel mounted to the rear side of the outer casing. Upon activation of the fan, air is drawing through the rear vented panel inward into the outer casing and out through the front vented panel and against the user.

In addition, the present invention is a method for keeping a user cool, dry, and comfortable when wearing a garment. The method comprises providing an outer casing having a front side and a rear side, directing the front side toward the user, directing the rear side toward the garment, mounting a fan between the front side and the rear side, powering the fan, securing the outer casing between the garment and the user, mounting a front vented panel to the front side of the outer casing, mounting a rear vented panel to the rear side of the outer casing, activating the fan, drawing air through the rear vented panel inward into the outer casing, and expelling air out through the front vented panel and against the user.

The present invention further includes a body fan device for keeping a user cool, dry, and comfortable when wearing a garment. The body fan device comprises an outer casing having a front side and a rear side with the front side directed toward the user and the rear side directed toward the garment. A fan is mounted between the front side and the rear side. Power means powers the fan. Securing means secures the outer casing between the garment and the user. A front vented panel mounted to the front side of the outer casing and a rear vented panel mounted to the rear side of the outer casing with the rear vented panel spaced from the garment. Upon activation of the fan, air is drawing through the rear vented panel inward into the outer casing and out through the front vented panel in a plurality of directions and against the user.

DETAILED DESCRIPTION OF THE PREFERRED EMBODIMENTS

Figure 3:
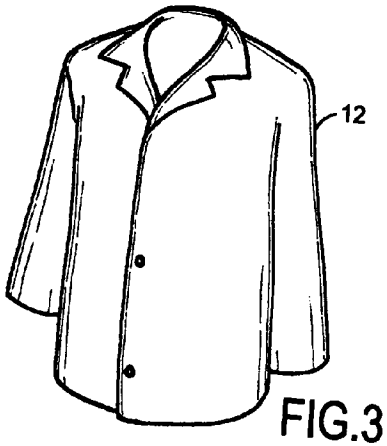
FIG. 3 is a perspective view illustrating a jacket incorporating the body fan device, constructed in accordance with the present invention.
Figure 4:
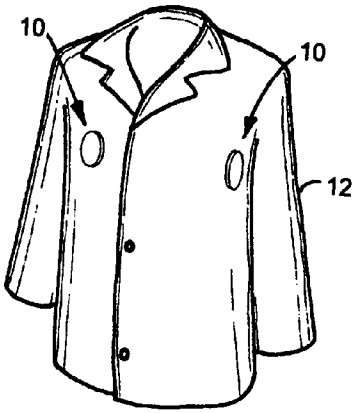
FIG. 4 is an outline perspective view illustrating the jacket incorporating the body fan device, constructed in accordance with the present invention.
Figure 2:
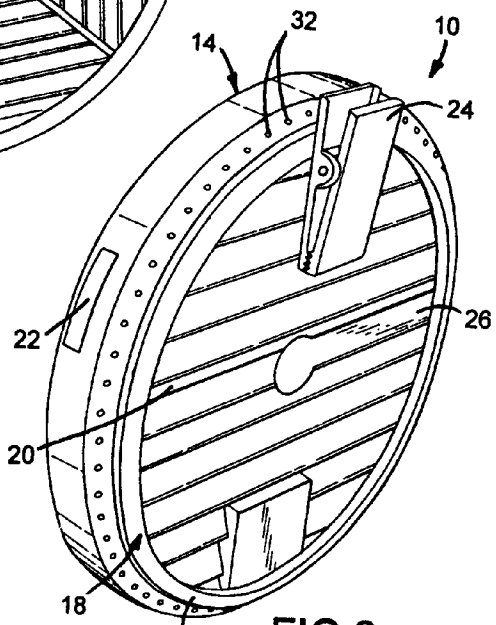
FIG. 2 is a rear perspective view illustrating the body fan device, constructed in accordance with the present invention.
Figure 1:
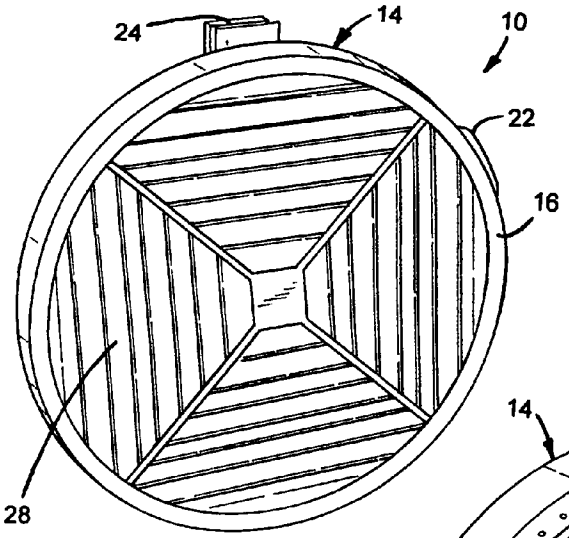
FIG. 1 is a front perspective view illustrating a body fan device, constructed in accordance with the present invention.

As illustrated in FIGS. 1-4, the present invention is a body fan device, indicated generally at 10, providing users a simple means of staying cool, dry, and comfortable when wearing business attire or other garments 12. The body fan device 10 of the present invention is worn underneath or incorporated into the design of newly manufactured garments 12 such as suit jackets or other clothing. Preferably, each garment 12 has two body fan devices 10 worn under the right and left underarm area although using any number of body fan devices 10 anywhere on the body is within the scope of the present invention so long as the body fan device 10 allows air to circulate through the garment 12, thus keeping the wearer cool and comfortable.

The body fan device 10 of the present invention comprises an outer casing 14 having a front side 16 and a rear side 18 with a battery-powered fan mounted 20 between the front side 16 and the rear side 18. Designed to rest flush below the underarms or other area of the body with the front side 16 directed toward the user, the fan 20 of the flat, disc-like body fan device 10 is powered by a small and extremely lightweight motor. An on/off switch 22 is mounted on the outer casing 14 for activating the fan 20. Removable, the body fan device 10 can be secured to the liner of the garment 12 by a spring-loaded clip 24 mounted on the rear side 18 of the outer casing 14 enabling the user to remove the body fan device 10 in order to launder or dry clean the garment 12.

Mounted to the rear side of the body fan device 10 of the present invention is a rear vented panel 26. Upon activation of the fan 20, the rear vented panel 26 allows air to be drawn inward into the outer casing 14 and out through a front vented panel 28 and against the user. A rim 30 is formed on the rear side 18 of the outer casing 14 and extends above the rear vented panel 26 allowing the rear vented panel 26 to be spaced from a garment 12 to promote maximum airflow therethrough. Additional spaced apertures 32 can be formed in the rear side 18 of the outer casing 14 between the rim 32 and a perimeter edge of the outer casing 14 for further providing an intake for air.

As stated above, the front vented panel 28 of the body fan device 10 of the present invention directs the air onto the user. Preferably, the front vented panel 28 directs the air in a plurality of directions, not just in a direction perpendicular to the outer casing 14. In a preferred embodiment, the front vented panel 28 actually directs the air in four different directions, i.e. in a generally upward direction, in a generally downward direction, in a generally left direction, and in a generally right direction.

While the body fan device 10 of the present invention have been described as being releasably secured to the garment 12 by a clip 24, it is within the scope of the present invention to incorporate the body fan device 10 in the garment 12 during manufacture of the garment. In this manner, the garment liner itself can be manufactured of a lightweight gauze or comparable fabric material and is peppered with a series of small, vented air holes working in conjunction with the previously mentioned body fan device 10. In the case of the body fan device 10 incorporated into the design of newly manufactured garments 12, the fabric shell comprises the actual lining of the garment 12 and thus can be produced from any number of materials and in a variety of colors. Further, the garment 12 themselves can be produced in a variety of sizes, styles and cuts appropriate for wear by male or female users.

The manner of use of the body fan device 10 of the present invention will now be described. It will be understood by those skilled in the art that the manner of use of the body fan device 10 described herein is merely one method of use and other methods of use of the body fan device 10 are within the scope of the present invention.

Wear of the body fan device 10 of the present invention is simple and straightforward. First, a user purchases the desired number of body fan devices 10 as needed or desired to keep them cool and comfortable to be worn in conjunction with an existing garment 12. The user simply dons the garment 12 and secures the body fan device 10 thereto making any necessary adjustments for a comfortable fit. Should one become excessively warm, they activate the attached cooling fan 20 of the body fan device 10, forcing air under the garment 12 and out the front vented panel 28. In this manner, air is blown on the body enabling the user to stay comfortable and dry. After use, the body fan devices 10 are removed and stored away until again needed.

Use of the body fan devices 10 of the present invention offers users many benefits and advantages. Foremost, the body fan devices 10 provide users a simple and efficient means of staying cool and comfortable when wearing business or other attire. A lightweight cooling system which blows air over the body, the body fan devices 10 enable users to wear a garment 12 without having to suffer the discomfort of being overly hot. This advantage proves particularly beneficial during hot spring and summer months, enabling users to dress appropriately for a business, formal, or casual event, without having to compromise comfort in the process. Blowing air over the body, the body fan devices 10 effectively thwart perspiration before it can saturate clothing. As such, users remove their jacket, for instance, with the confidence that their dress shirt is fresh and dry. Fighting stains and preventing odors, use of the body fan devices 10 prolong the life of the garment. In addition to daily use, the body fan devices 10 prove especially beneficial at particular moments when an extra level of protection may be needed. For example, during special events such as weddings and job presentations, the body fan devices provide the wearer with peace of mind, especially as anxiety or nervousness can often lead to excessive perspiration. Easily donned and comfortable to wear, the body fan devices 10 are ideal for use by male and female users alike. In sum, the body fan devices 10 of the present invention provide users an easy and efficient means of maintaining cool comfort when wearing dress or business attire or any other type of garment 12.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein may be suitably practiced in the absence of the specific elements which are disclosed herein.

What is claimed is:

1. A body fan device for keeping a user cool, dry, and comfortable when wearing a garment, the body fan device comprising:

an outer casing having a front side and a rear side, the front side directed toward the user, the rear side directed toward the garment;

a fan mounted between the front side and the rear side;

power means for powering the fan;

securing means for securing the outer casing between the garment and the user;

a front vented panel mounted to the front side of the outer casing; and a rear vented panel mounted to the rear side of the outer casing;

wherein upon activation of the fan, air is drawing through the rear vented panel inward into the outer casing and out through the front vented panel and against the user.

2. The body fan device of claim 1 and further comprising:

a plurality of body fan devices spaced from each other relative to the user.

3. The body fan device of claim 1 wherein the power means is a lightweight, battery-powered motor.

4. The body fan device of claim 1 and further comprising:

an on/off switch mounted on the outer casing for selectively activating the fan.

5. The body fan device of claim 1 wherein the securing means is a spring-loaded clip mounted on the rear side of the outer casing.

6. The body fan device of claim 1 and further comprising:

a rim formed on the rear side of the outer casing, the rim extending above the rear vented panel allowing the rear vented panel to be spaced from a garment.

7. The body fan device of claim 6 and further comprising:

a plurality of spaced apertures formed in the rear side of the outer casing between the rim and a perimeter edge.

8. The body fan device of claim 1 wherein the front vented panel directs the air in a plurality of directions.

9. The body fan device of claim 8 wherein the front vented panel directs the air in four different directions.

10. A method for keeping a user cool, dry, and comfortable when wearing a garment, the method comprising:

providing an outer casing having a front side and a rear side;

directing the front side toward the user;

directing the rear side toward the garment;

mounting a fan between the front side and the rear side;

powering the fan;

securing the outer casing between the garment and the user;

mounting a front vented panel to the front side of the outer casing;

mounting a rear vented panel to the rear side of the outer casing;

activating the fan;

drawing air through the rear vented panel inward into the outer casing; and expelling air out through the front vented panel and against the user.

11. The method of claim 10 and further comprising:

mounting an on/off switch on the outer casing for selectively activating the fan.

12. The method of claim 10 and further comprising:

mounting a spring-loaded clip on the rear side of the outer casing.

13. The method of claim 10 and further comprising:

forming a rim on the rear side of the outer casing;

extending the rim above the rear vented panel; and allowing the rear vented panel to be spaced from a garment.

14. The method of claim 13 and further comprising:

forming a plurality of spaced apertures in the rear side of the outer casing between the rim and a perimeter edge.

15. The method of claim 1 and further comprising:

directing the air in a plurality of directions through the front vented panels.

16. The method of claim 15 and further comprising:

directing the air through the front vented panel in four different directions.

17. A body fan device for keeping a user cool, dry, and comfortable when wearing a garment, the body fan device comprising:

an outer casing having a front side and a rear side, the front side directed toward the user, the rear side directed toward the garment;

a fan mounted between the front side and the rear side;

power means for powering the fan;

securing means for securing the outer casing between the garment and the user;

a front vented panel mounted to the front side of the outer casing; and a rear vented panel mounted to the rear side of the outer casing, the rear vented panel spaced from the garment;

wherein upon activation of the fan, air is drawing through the rear vented panel inward into the outer casing and out through the front vented panel in a plurality of directions and against the user.

18. The body fan device of claim 17 wherein the securing means is a spring-loaded clip mounted on the rear side of the outer casing.

19. The body fan device of claim 17 and further comprising:

a rim formed on the rear side of the outer casing, the rim extending above the rear vented panel allowing the rear vented panel to be spaced from a garment.

20. The body fan device of claim 17 wherein the front vented panel directs the air in four different directions.

* * * * *